United States Patent [19]

Allen

[11] Patent Number: 4,799,638

[45] Date of Patent: Jan. 24, 1989

[54] HOLDER FOR A BEVERAGE CONTAINER

[76] Inventor: Louis Allen, 166 E. 61 St., New York, N.Y. 10021

[21] Appl. No.: 69,847

[22] Filed: Jul. 6, 1987

[51] Int. Cl.[4] ..... A47K 1/08

[52] U.S. Cl. ..... 248/311.2; 248/231.8; 297/188

[58] Field of Search ..... 248/311.2, 310, 314, 248/309.1, 313, 314, 231.7, 231.8; 299/188, 194

[56] References Cited

U.S. PATENT DOCUMENTS

| | | | |
|---|---|---|---|
| 1,021,328 | 3/1912 | Noll | 248/312 |
| 1,855,009 | 4/1932 | Clegg | 248/313 |
| 2,995,333 | 8/1961 | Pazzano | 248/314 X |
| 3,021,106 | 2/1962 | Kramer | 248/311.2 X |
| 3,116,046 | 12/1963 | Risdon | 297/188 X |
| 3,881,677 | 5/1975 | Ihlenfeld | 248/311.2 |
| 4,063,701 | 12/1977 | Wray | 248/310 X |
| 4,548,326 | 10/1985 | Danna et al. | 297/194 X |
| 4,560,128 | 12/1985 | Willeby et al. | 297/188 X |

*Primary Examiner*—Ramon O. Ramirez
*Attorney, Agent, or Firm*—Natter & Natter

[57] ABSTRACT

A holder for a beverage container includes a saddle spring clip for releasably securing the device to a chair. The clip is provided with a notched recess for snap-fitting engagement over a cross-bolt connection between a chair seat frame and a chair leg. A selectively rotatable receptacle, such as a socket member for accommodating a beverage container is supported from the clip and is preferably located below the plane of the seat frame. A plurality of upstanding posts and a base member confine the container, for side and bottom-gripping of the container. The posts are provided with flared ends to center the container for reinsertion within the socket. The posts also provide for reinsertion or removal of the container through the top or side of the socket. In an alternate embodiment a pouch member is substituted for the socket member.

15 Claims, 3 Drawing Sheets

FIG. 1
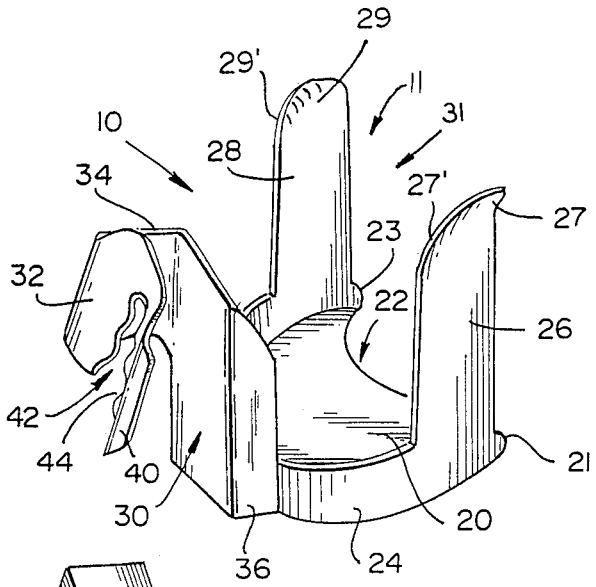
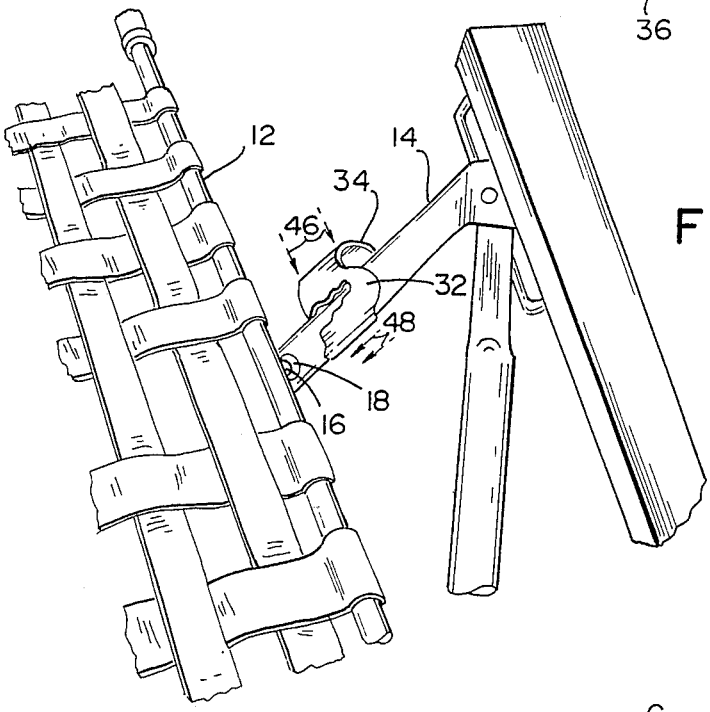
FIG. 2
FIG. 3
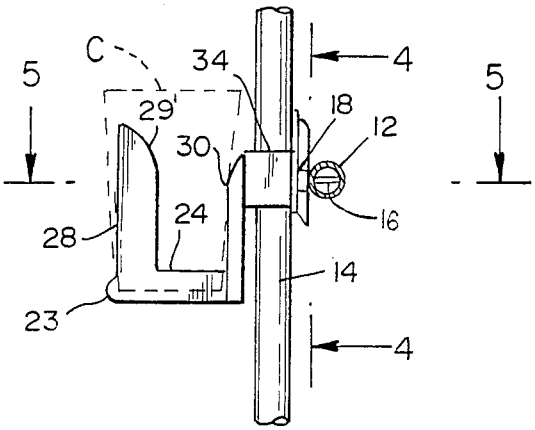

FIG. 4
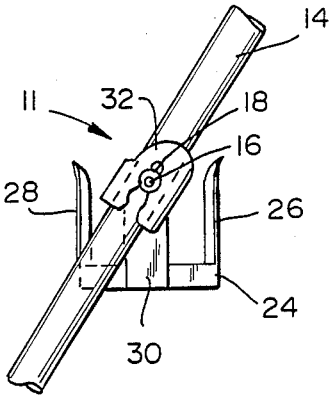
FIG. 4A
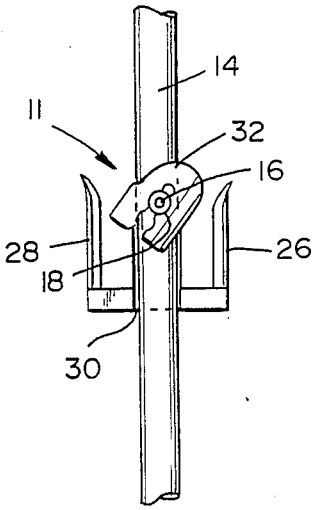
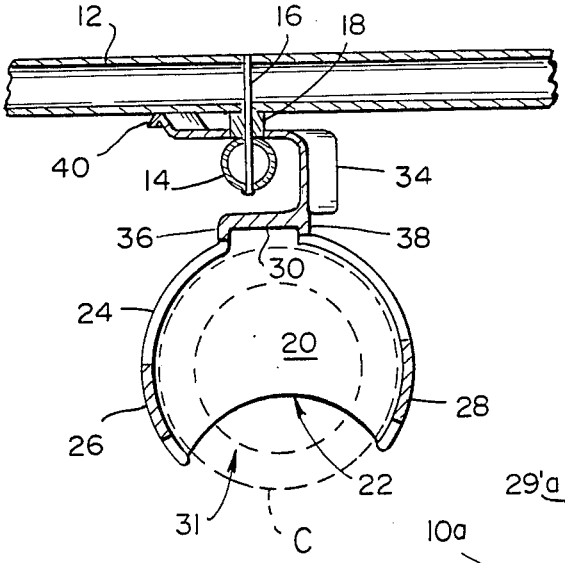
FIG. 5
FIG. 6
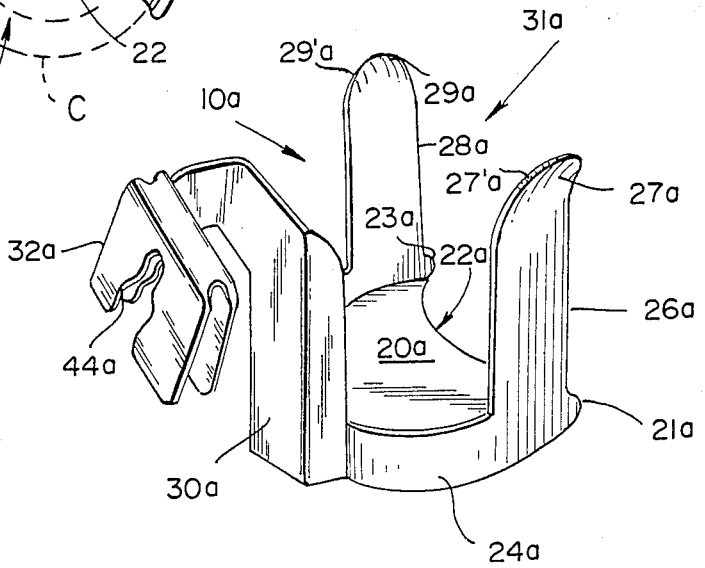

HOLDER FOR A BEVERAGE CONTAINER

FIELD OF THE INVENTION

This invention relates generally to article-holding devices and especially to a holder for a beverage container or the like.

In particular, the holder of this invention concerns an auxiliary support attachable to a chair for providing proximal accessability to the occupant of the chair.

BACKGROUND ART

Outdoor lawn and patio furniture is frequently manufactured with an articulateed tubular aluminum frame to provide a lightweight, foldable, and readily transportable chair for relaxing on a beach, patio, lawn or in a similar environment. The persons using these articles of furniture usually do not have the indoor luxury of a nearby coffee table, stand or other elevated platform for the placement of small personal articles, beverage containers or the like.

Various devices have attempted to provide auxiliary supports including supports attachable to articles of furniture. Typical among those devices are holders that relied upon a clamp secured to a leg of a chair, as for example was shown in U.S. Pat. Nos. 3,021,106, 4,063,701 and 4,256,281. Those attachments, as noted, usually required a tool for their installation and necessitated the time-consuming removal and disassembly when the chair was folded for transport or storage. This presented a distinct inconvenience and disadvantage.

Other devices incorported integral support surfaces within the armrest of the chair or otherwise provided for extensions of the arm support such as typically shown in U.S. Pat. Nos. 3,233,940, 4,003,598, 3,329,272 and 4,548,326. The construction of those devices had inherent limitations and restricted use of the arm support. Furthermore,those support arrangements, located relatively high on the chair, did not provide cup stability and inadvertent arm movement could tip over beverage containers mounted at armrest level.

Another problem of previous beverage container supports, especially those supports located below the chair armrest was that they relied upon a ringed cup-holding member as exemplified by the apparatus of U.S. Pat. Nos. 3,021,106 and Des. 226,623. A shortcoming of those supports was that the beverage container required gripping at the upper portion when lifted. Otherwise, the lifting necessitated the use of two hands for the reason that the container-gripping hand could not pass over the ringed member. In supports without a ringed cup-holding member, recessed areas were required for cup confinement, such as shown in U.S. Pat. No. 4,560,128. The paper cup, however, had to be gripped along a top margin for removal. The lifting of a laden paper cup, along the upper portion or the margin of the lip was not preferred as this was the structurally weakest portion of the cup, and given to deformation, especially when stubbornly held by the cup-holding member. Therefore, a deficiency of those supports was that the container could not be conveniently or securely removed.

SUMMARY OF THE INVENTION

The purpose of this invention is to provide a holder for a beverage container that is convenient to use and which overcomes the disadvantages, shortcomings and limitations of the previously described devices.

Briefly, the device of this invention includes a socket for accommodating a beverage container having a base member, and one or more posts extending upwardly around the periphery of the base member and along the longitudinal axis of the container, without transversely circumscribing the container. The height of the posts can be greater than the depth of the cup-confining recesses of the previously described supports for greater container stability.

The base member is supported by a chair-attachable clip, which is connected to the base member by a rigid strap. The clip includes a curved collar portion which generally conforms to a leg of the chair. The clip is intended to straddle a cross-bolt or similar connection between the seat frame and the leg member of the chair. A notched recess within the clip preferably provides for snap-fit engagement over the cross-bolt and permits rotatable adjustment for orienting the base member horizontally with respect to the ground surface. The clip also is retained in a frictionally engaged relationship by a wedging action or by a resilient spring action, which urges the clip against the respective frame portion of the seat and/or the leg.

Having thus summarized the invention, it will be seen that it is an object thereof to provide a holder for a beverage container of the general character described herein which is not subject to the aforementioned deficiencies.

Specifically, it is an object of this invention to provide a holder for a beverage container which suspends the container below the armrest level of a chair.

Another object of this invention is to provide a holder for a beverage container which is releasably mountable to a chair and adjustably positionable for providing a horizontal support surface.

A further object of this invention is to provide a holder for a beverage container which includes a container-confining socket which does not circumscribe the container about the transverse axis so as to permit a container to be gripped at the bottom and removed from the socket in an unobstructed upward or upward and sideward lifting action.

Still another object of this invention is to provide a holder for a beverage container which utilizes a resilient saddle clip for engagement with the chair without the need for tools and without the need for removal when the chair is folded.

Yet still another object of this invention is to provide a holder for a beverage container which is simple in construction, low in cost, reliable in use, and well adapted for mass production fabrication techniques.

Other objects of this invention in part will be apparent and in part will be pointed out hereinafter.

With these ends in view, the invention finds embodiment in certain combinations of elements, and arrangements of parts, by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention:

FIG. 1 is a perspective view showing a holder for a beverage container in accordance with this invention;

FIG. 2 is a perspective view illustrating the attachment of the holder to a chair;

FIG. 3 is an elevational view, partially in section, showing the holder mounted to the chair including a socket member for retaining a beverage container and a clip seated over a cross-bolt connecting a seat frame to a leg member of the chair;

FIG. 4 is an auxiliary view taken substantially along line 4—4 of FIG. 3 illustrating the relationship between the clip and the socket member when mounted to the chair with the leg member being inclined relative to the seat frame;

FIG. 4A is an auxiliary view of an alternate embodiment of the device shown in FIG. 4 wherein the leg member is substantially vertical;

FIG. 5 is a sectional view taken substantially along line 5—5 of FIG. 3 showing a portion of the seat frame member and the leg member of the chair and the placement of the socket member and clip in relation thereto;

FIG. 6 is a perspective view of an alternate embodiment of the holder showing a bifurcated clip;

DETAILED DESCRIPTION OF THE INVENTION

Figure 7:
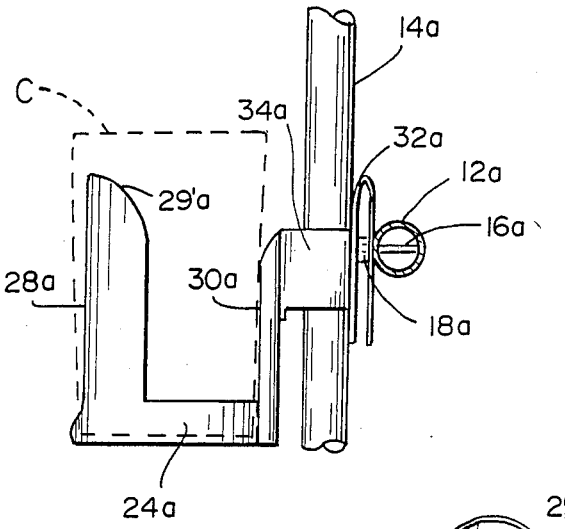
FIG. 7 is an elevational view, partially in section, of the alternate embodiment showing the holder of FIG. 6 mounted to a chair.

Referring now in detail to the invention, the reference numeral 10 denotes generally a holder for a beverage container in accordance with this invention.

The holder 10, is designed to be mounted to a chair, and especially to a chair having a tubular frame construction such as shown in FIG. 2, which includes a seat frame 12 and a leg member 14 secured to the frame by a cross-bolt 16. A grommet 18, surrounds the cross-bolt 16 and spaces the frame 12 from the leg member 14 to provide an interstice.

The holder 10 includes a container-receiving cylindrical socket 11, having a substantially planar platform or base 20 which is generally circular in shape and is provided with a crescent-shaped indented portion or opening 22. The indented portion 22 provides access to a bottom surface of the beverage container C, for lifting, as will be explained hereinafter and may vary in number, size, shape and in location on the base 20.

An upstanding flange 24, extends along the periphery of the base 20 as shown in FIG. 1. In addition, a set of container-confining resilient post members 26, 28 conforming to the periphery of the base 20 project upwardly substantially parallel to the length direction of the container C and flare outwardly at their upper ends 27,29 respectively. A pair of shoulders 21,23 at the lower ends of the posts 26,28 respectively function to retain the beverage container C within the socket 11 and to prevent unintentional removal by lateral displacement. A rigid strap 30 provides a structural interconnection between the base 20 and a saddle clip 32.

The post members 26,28 and the strap 30 extend substantially vertically and along the longitudinal axis of the container and the flared ends, 27,29 provide a centering guide for unobstructed inserting of the container into the socket member 11. The flared ends 27,29 also provide increased clearance so as not to obstruct container insertion or removal. A tapered edge portion 27',29' facilitates removal of the container especially when lifted in a continuous upward and lateral motion. For example, the container-gripping thumb and finger can pass over the upper ends 27,29 of the post members 26,28 without requiring a vertical displacement equivalent to the maximum height dimension of the post members 26,28 before moving in a sideward direction.

The strap 30 further includes a curved collar portion 34 which conforms to and partially surrounds the chair leg 14. The strap 30 is also provided with inturned edges 36, 38 for structural rigidity. The collar 34 may similarly be provided with out-turned edges (not shown) for structural rigidity.

The saddle clip 32 includes a laterally off-set wing 40—the function of the wing 40 will be described hereinafter—and an opening 42 having an edge defining a plurality of complementary notches 44. The width of the opening 42 is progressively diminished in the direction of its depth.

It should also be observed that the clip 32 and the collar portion 34 are angularly oriented with respect to the strap 30 extending from the base 20. The angular orientation is intended to coincide with the angle of inclination of a typical chair leg 14 when in its functional position. The length dimension of the clip 32 can also be extended for alternate use as a stake insertable into a permeable surface such as sand.

The holder 10 of this invention may be constructed of a plastic material and formed integrally as a unitary component. The material selected, however, should provide the clip 32 and the socket 11 with resilient flexibility that is required in accordance with the following description of its operation.

The holder 10 is attached to a chair by placing the saddle clip 32 and collar portion 34 around the chair leg 14 and by then urging the clip 32 in the direction of the arrows 46 as shown in FIG. 2. The clip 32 is then urged in a downward direction as shown by the arrows 48 with the opening 42 in registered alignment over the cross-bolt 16 and the grommet 18. The clip 32 is seated over the appropriate notches 44 until the grommet 18 or the cross-bolt 16 rests between complementary notches 44 in snap-fitting engagement and may be wedged between the grommet 18 and the leg 14 or the grommet 8 and and the seat frame 12. The wing 40 is also spring-urged against the seat frame 12 as shown in FIGS. 3 and 5 and frictionally contacts the opposed surfaces of the interstice. The base member 20 will then be suspended to a position such as shown in FIG. 4, and substantially horizontal to the ground surface. In the event the chair leg 14 is positioned in a near-vertical orientation, as in FIG. 4A, rather than inclined as in FIG. 4, the clip 32 can be rotated about the cross-bolt 16 without adversely affecting the support function.

The holder 10 can be rotated as will be necessary if the leg 14 is vertical. The range of rotation is determined by the length dimension of the collar 34, measured along the length of the leg 14 and the width dimension between the opening 42 on the clip 32 and the collar 34. Decreasing the length dimension of the collar 34 and increasing the width dimension between the opening 42 and the collar 34 will increase the range of rotation. The space circumscribed by the clip 32, the collar 34 and the strap 30 will preferably accommodate the largest thickness or diameter of a typical chair leg 14 to the smallest diameter chair leg 14 without impairment to the rotation function. The chair may also be folded while the clip 32 is engaged. It should be noted the clip 32 ay also be made without the wing 40, thereby relying only on the aforementioned wedging action and snap-fitting engagement for securement.

When the holder 10 is mounted to the chair, the base 20 will be positioned below the seat frame 12 and will be readily accessible to the occupant of the chair, yet will place the beverage container at a relatively low, stable location, which will not interfere with arm movement or use of the chair armrest. In addition, the post members 26, 28 permit a continuous upward or upward and laterally outward hand motion in removing the beverage container. The laterally outward displacement will remove a typical container C through a passageway 31 between posts 26,28. The container C can be replaced within the socket 11 in a reverse manner. In order to further facilitate removal and secure handling of the beverage container, the opening 22 has been provided. This provides access to the bottom-lifting surface of the container C without regard to the height of the posts 26,28, and affords firm gripping, especially when dislodging a fluid-laden paper container which would otherwise deform when gripped along the top. It should be seen that the socket 11 may employ only one post 26, if the strap 30 and the post 28 are coextensively integrated along the periphery of the base 20.

It should be noted that the several components including the base member, the strap member, and the clip member can be welded, riveted, or releasably fastened as by a bolt and wing nut.

An alternate embodiment of the invention is illustrated in FIGS. 6 and 7 wherein like numerals have been used for designating corresponding parts with the addition of the suffix "a". A holder **10*a* is similar in construction to that shown in FIG. 1 as previously described, with the exception that a bifurcated spring clip 32*a* has been substituted. The spring clip 32*a* provides a biasing force and frictionally bears against a chair leg 14*a* and a seat frame 12*a* for mounting the holder 10*a*** to a chair.

Figure 8:
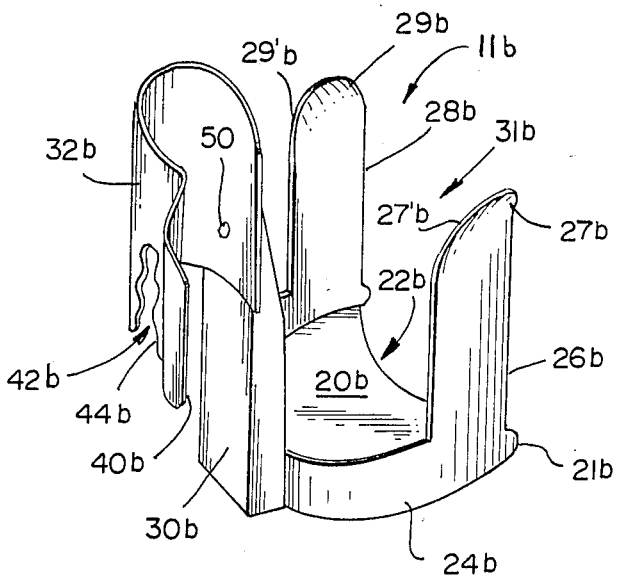
FIG. 8 is a perspective view of a further embodiment of the holder of this invention showing a variation of the clip formed as an independent component and rivet connected to a strap member.

A further embodiment is illustrated in FIG. 8 wherein like numerals have been used to repreesnt corresponding parts with the addition of the suffix "b". In this instance, a holder **10*b* includes a strap member 30*b* which is joined to a curvilinear saddle clip 32*b* by a rivet 50. It should be noted that the previous collar portion has been incorporated in the clip 32*b*. The device 10*b* is in all other respects similar in construction and operation to the invention as previously described except that the socket 11*b* is rotatable about the rivet 50 and the clip 32*b* need not be rotatable about the cross-bolt 16*b***.

Figure 9:
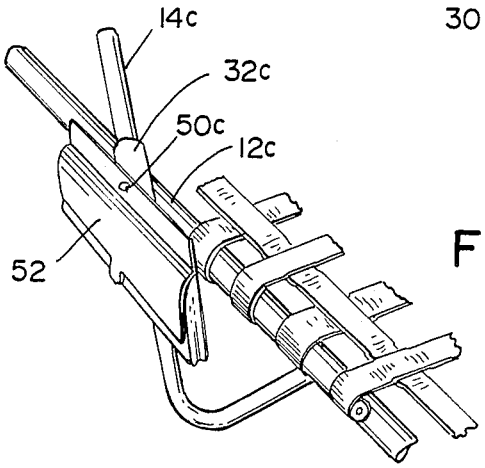
FIG. 9 is a perspective view of a further variant embodiment similar to that shown in FIG. 8 with the substitution of a carrying pouch in place of the socket member.

Another variant form of the invention is shown in FIG. 9 wherein like numerals have been used for designating corresponding parts with the addition of the suffix "c". In this version, a saddle clip **32*c* corresponds generally to the component 32*b* shown in FIG. 8 and a pouch 52 has been connected to the clip 32*c* by a rivet 50*c*. The pouch 52 is intended to replace the socket 11*b*. It should further be apparent that a bolt and wing nut (not shown) can be substituted for the rivet 50*c* such that the pouch 52** can be selectively replaced by a socket member.

It should thus be seen that the beverage holder of this invention provides an improved and efficient device for detachable securement to an article of furniture and that it is well adapted to meet the conditions of practical use. Since various possible embodiments may be made of the present invention and further changes may be made in the exemplary embodiments set forth herein, it is to be understood that all material set forth or shown in the accompanying drawings are to be interpreted as illustrative and not in a limiting sense.

Having thus described the invention, there is claimed as new and desired to be secured by Letters Patent:

1. A holder for a beverage container adapted for attachment to a chair having a seat frame and a leg member including a cross-bolt for connecting the seat frame to the leg member wherein an interstice is provided between the seat frame and the leg member, said holder comprising a receptacle for accommodating selected articles, a saddle clip for removably securing the receptacle to the chair and strap means for connecting the receptacle to the saddle clip, said strap means further including a collar portion generally conforming to and partially surrounding the leg member in non-gripping contact, said saddle clip further defining a notched opening for snap-fitting engagement over the cross-bolt wherein the saddle clip is rotatable about the cross-bolt for positioning the receptacle.

2. A holder for a beverage container as claimed in claim 1 wherein the receptacle includes socket means, said socket means having a substantially planar base member and post means for confining the beverage container.

3. A holder for a beverage container as claimed in claim 2 wherein the base member defines an opening, said opening providing access to a bottom-lifting surface of the container.

4. A holder for a beverage container as claimed in claim 3 wherein the post means extend substantially parallel to the length dimension of the container and define a passageway for lateral removal of the container from the socket means.

5. A holder for a beverage container as claimed in claim 3 wherein the post means defines a space for providing hand-gripping access of the container proximate the base member for container removal from the socket means.

6. A holder for a beverage container as claimed in claim 5 wherein the post means include a flared end for providing a centering guide during insertion of the container.

7. A holder for a beverage container as claimed in claim 6 wherein an edge surface of the post means is tapered at the flared end to provide thumb and finger grip clearance for removing the container in an upward and lateral motion.

8. A holder for a beverage container as claimed in claim 1 wherein the range of rotation is determined by the length dimension of the collar portion.

9. A holder for a beverage container as claimed in claim 1 wherein the saddle clip includes a laterally offset wing for providing frictional contact between opposed surfaces of the interstice.

10. A holder for a beverage container as claimed in claim 1 further including a bifurcated spring urged saddle clip means for providing a biasing force against the chair leg and seat frame.

11. A holder for a beverage container as claimed in claim 1 wherein the saddle clip incorporates the collar portion and is rotatably attachable to the strap means for adjustable positioning of the socket means.

12. A holder for a beverage container as claimed in claim 1 wherein the saddle clip is detachably connectable to the receptacle.

13. A holder for a beverage container as claimed in claim 12 wherein the receptacle defines a pouch.

14. A holder for a beverage container as claimed in claim 2 wherein the socket means is suspended below the plane of the seat frame.

15. A holder for a beverage container adapted for removable securement to a chair having a seat frame and a leg member with the seat frame being spaced from the leg member to define an interstice and a connector member spanning between said seat frame and the leg member, said holder comprising a receptacle including a substantially planar base member and post means extending upwardly from the base member for confining a beverage container, a saddle clip having an opening and notch means for engagement with the connector member, said saddle clip being insertable within said interstice and seatable over the connector member, said saddle clip further having resilient means for frictionally engaging the interstice with said saddle clip being rotatably displaceable about the connector member for orienting the receptacle, and strap means for connecting the receptacle to the saddle clip including a collar portion circumscribing a space around the leg member for defining the range of rotatable displacement.

* * * * *